US006810699B2

(12) United States Patent
Nagy

(10) Patent No.: US 6,810,699 B2
(45) Date of Patent: Nov. 2, 2004

(54) FIXED-LEAF LOCK MECHANISM

(75) Inventor: Siegfried Nagy, Velbert (DE)

(73) Assignee: Carl Fuhr GmbH & Co. KG, Heiligenhaus (DE)

( * ) Notice: Subject to any disclaimer, the term of this patent is extended or adjusted under 35 U.S.C. 154(b) by 0 days.

(21) Appl. No.: 10/353,147

(22) Filed: Jan. 28, 2003

(65) Prior Publication Data

US 2003/0159478 A1 Aug. 28, 2003

(30) Foreign Application Priority Data

Feb. 27, 2002 (DE) ..... 102 09 575

(51) Int. Cl.[7] ..... E05B 59/00; E05B 63/14

(52) U.S. Cl. ..... 70/107; 70/DIG. 52; 70/DIG. 65; 292/36; 292/39; 292/341.15; 292/DIG. 21

(58) Field of Search ..... 70/107–110, DIG. 52, 70/DIG. 65; 292/36, 39, 341.15, DIG. 21

(56) References Cited

U.S. PATENT DOCUMENTS

| | | | | | |
|---|---|---|---|---|---|
| 998,642 | A | * | 7/1911 | Shean | 292/36 |
| 1,168,524 | A | * | 1/1916 | Lurie | 70/142 |
| 1,368,141 | A | * | 2/1921 | Hagstrom | 292/34 |
| 1,597,682 | A | * | 8/1926 | Hagstrom | 292/36 |
| 5,197,771 | A | * | 3/1993 | Kaup et al. | 292/45 |
| 5,819,562 | A | * | 10/1998 | Christ | 70/107 |
| 5,901,989 | A | * | 5/1999 | Becken et al. | 292/35 |
| 6,266,981 | B1 | * | 7/2001 | von Resch et al. | 70/107 |
| 2002/0104339 | A1 | * | 8/2002 | Saner | 70/108 |

FOREIGN PATENT DOCUMENTS

| | | | |
|---|---|---|---|
| DE | 2914377 | * 10/1980 | 292/DIG. 21 |

OTHER PUBLICATIONS

Einsteck–Baskülschloss Nr. 298 R, p. 21, 1993, Applicant's Catlogue 23.

* cited by examiner

*Primary Examiner*—Lloyd A. Gall
(74) *Attorney, Agent, or Firm*—Martin A. Farber

(57) ABSTRACT

An espagnolette (1) for the fixed leaf of a double-leaf door, having a lock case (5) in which there is mounted a handle follower (9) by rotational actuation of which at least one driving rod (20, 26) can be displaced parallel to a lock case front (6), the end of the rod forming or controlling a bolt, the espagnolette having an entry opening (7, 8) for a bolt (4) or a latch (3) of a lock (2) associated with the moving leaf, a driving-rod connection slide (20, 26) which is guided in the lock case (5) being assigned a blocking element (28, 29) which, in the open position of the lock mechanism (1), is located in the region of the entry opening (7, 8), in order to obstruct the entry of the bolt (4) of the moving-leaf lock mechanism, and, in the locked position of the lock mechanism (1), is located outside the region of the entry opening (8) such that the displaceability of the driving rod (26) into the open position can be blocked by entry of the bolt (4) of the moving-leaf lock mechanism. Improving a fixed-leaf lock mechanism of a door lock for a double-leaf door, the follower (9) acts on the driving rod (26) by a lever-transmission mechanism (H), a link (11) which acts, at one end, on a driving-rod drive lever (13) and, at the other end, on an arm (10) of the handle follower (9) being brought over a dead-center position (T) when the follower (9) is rotated.

13 Claims, 6 Drawing Sheets

1
2
6
27
13
14
5
15
17
16
18
11
10
12
19
9
39
38
24
30
23
33
31
32
7
3
28
22
21
22
20
25
30
26
29
4
8
H
27
30

1
2
6
27
13
14
5
15
17
16
7
H
3
28
18
11
22
10
21
12
41
19
22
9
39
20
40
38
26
30
25
24
23
30

1
2
6
27
14
5
15
28
7
3
22
20
19
22
21
H
17
16
18
11
10
12
9
39
38
24
30
23
33
31
32
25
30
26
4
8
29
27
30

1
2
6
27
5
H
28
22
21
17
7
T
14
13
3
16
15
22
19
11
18
10
12
41
9
T
39
40
38
20
26
30
25
24
23
30

FIXED-LEAF LOCK MECHANISM

FIELD AND BACKGROUND OF THE INVENTION

The invention relates to an espagnolette for the fixed leaf of a double-leaf door, having a lock case in which there is mounted a handle follower by rotational actuation of which at least one driving rod can be displaced parallel to a lock case front, the end of the rod forming or controlling a bolt, the espagnolette having an entry opening for a bolt or a latch of a lock mechanism associated with the moving leaf, a driving-rod connection slide which is guided in the lock case being assigned a blocking element which, in the open position of the lock mechanism, is located in the region of the entry opening, in order to obstruct the entry of the bolt of the moving-leaf lock mechanism, and, in the locked position of the lock mechanism, is located outside the region of the entry opening such that the displaceability of the driving rod into the open position can be blocked by entry of the bolt of the moving-leaf lock mechanism.

Such an espagnolette is disclosed in the applicant's catalogue 23. Page 21 of the latter shows an espagnolette from 1993. This lock interacts with a moving-leaf lock mechanism and has a lock case in which two driving-rod connection slides which can be extended in opposite directions are guided. The two driving-rod connection slides are driven by a follower which is mounted in a rotatable manner in the lock case. The follower has two diametrically opposite slots in which drive pins of the respective driving-rod connection slides are positioned. One of the two driving-rod connection slides has a pin which, in the locked position of the lock, is located in the movement region of the bolt of the moving-leaf lock mechanism, in order to prevent the bolt of the moving-leaf lock mechanism from entering into the bolt-entry opening in the open position of the fixed-leaf lock mechanism. The bolt of the moving-leaf lock mechanism can only be extended fully into the bolt-entry opening in the locked position of the fixed-leaf lock mechanism. In this extended position, the bolt is located in the movement path of the blocking element with the result that the fixed-leaf lock mechanism cannot be moved into its open position. The movement of the driving-rod connection slide is blocked by the bolt of the moving-leaf lock mechanism.

SUMMARY OF THE INVENTION

It is an object of the invention to improve the fixed-leaf lock mechanism of a door lock mechanism for a double-leaf door.

According to the invention the follower acts on the driving rod by way of a lever-transmission mechanism, a link which acts, at one end, on a driving-rod drive lever and, at the other end, on an arm of the handle follower being brought over a dead-center position when the follower is rotated. As a result of this configuration, the driving rod, in its locked position, is locked against being returned. Furthermore, the driving-rod drive lever allows the displacement of the driving rod to be increased up to a displacement of 25 mm or more. The driving-rod drive lever is preferably a single-armed lever, one end of which is mounted in a rotatable manner in the lock case and the other end of which acts on a driving-rod connection slide. It is possible for the link to act between the two ends of the driving-rod drive lever. In a preferred development of the invention, the handle follower has play for movement in relation to the follower arm. This allows the follower to be fixed in a neutral center position by means of a spring assembly. The follower can be rotated out of the neutral center position, counter to the restoring force of the spring assembly, in order to displace the driving rod either into the locked position or into the open position. It is possible for a spring to act on the driving-rod drive lever. It is preferable for a leg spring which is wound around the drive pin of the driving-rod drive lever to act on the latter, in order to spring-load the driving rod in the direction of its open position. As a result of this spring loading, all that is required is for the lever-transmission mechanism to be brought over the dead-center position by virtue of the handle being actuated in the opening direction. The spring then ensures that the driving rod is displaced into the open position. A variant of the invention provides that the lock has two driving-rod connection slides which can be extended in opposite directions. Each driving-rod connection slide is assigned a bolt, so that one bolt can extend downward and one bolt can extend upward. The two driving-rod connection slides may be coupled for movement via a gearwheel. It is further possible to provide a second entry opening for a second bolt or a latch of the moving-leaf lock mechanism. It is preferable for one entry opening to be assigned a latch, and the other entry opening to be assigned a bolt, of the moving-leaf lock mechanism. The two entry openings may each be blocked by a blocking element, so that the bolt or the latch can only move all the way into the entry opening when the driving rods are brought into the locked position. It may be provided, however, that the latch or the bolt can move part of the way into the entry openings when the lock mechanism is brought into the open position. It is thus possible for the latch to spring part of the way into the entry opening associated with it. The bolt can move part of the way into the entry opening associated with it. The partial displacement part of the bolt may be less than the first-turn extension path of the bolt. This results in it not being possible for the key which is associated with the moving-leaf lock mechanism to be withdrawn when the fixed-leaf lock mechanism is located in the open position. It is also possible, however, for the bolt to extend merely by one turn when the fixed-leaf lock mechanism is open. The blocking element is preferably formed by an angled portion of a driving-rod connection slide, which is formed as a punched and bent part. It may further be provided that the fixed leaf also has a key-actuable lock, in particular a lock cylinder. This lock makes it possible to displace a blocking bolt within the lock case. This blocking bolt, in its blocking positions is positioned in the movement part of the driving-rod connection slide located in the locked position, so that the fixed-leaf lock mechanism can only be opened when the key-actuatable lock is displaced into the open position. This blocking bolt may have a spring-activated tumbler.

BRIEF DESCRIPTION OF THE DRAWINGS

An exemplary embodiment of the invention is explained hereinbelow with reference to drawings, in which.

DETAILED DESCRIPTION OF THE PREFERRED EMBODIMENT

Figure 1:
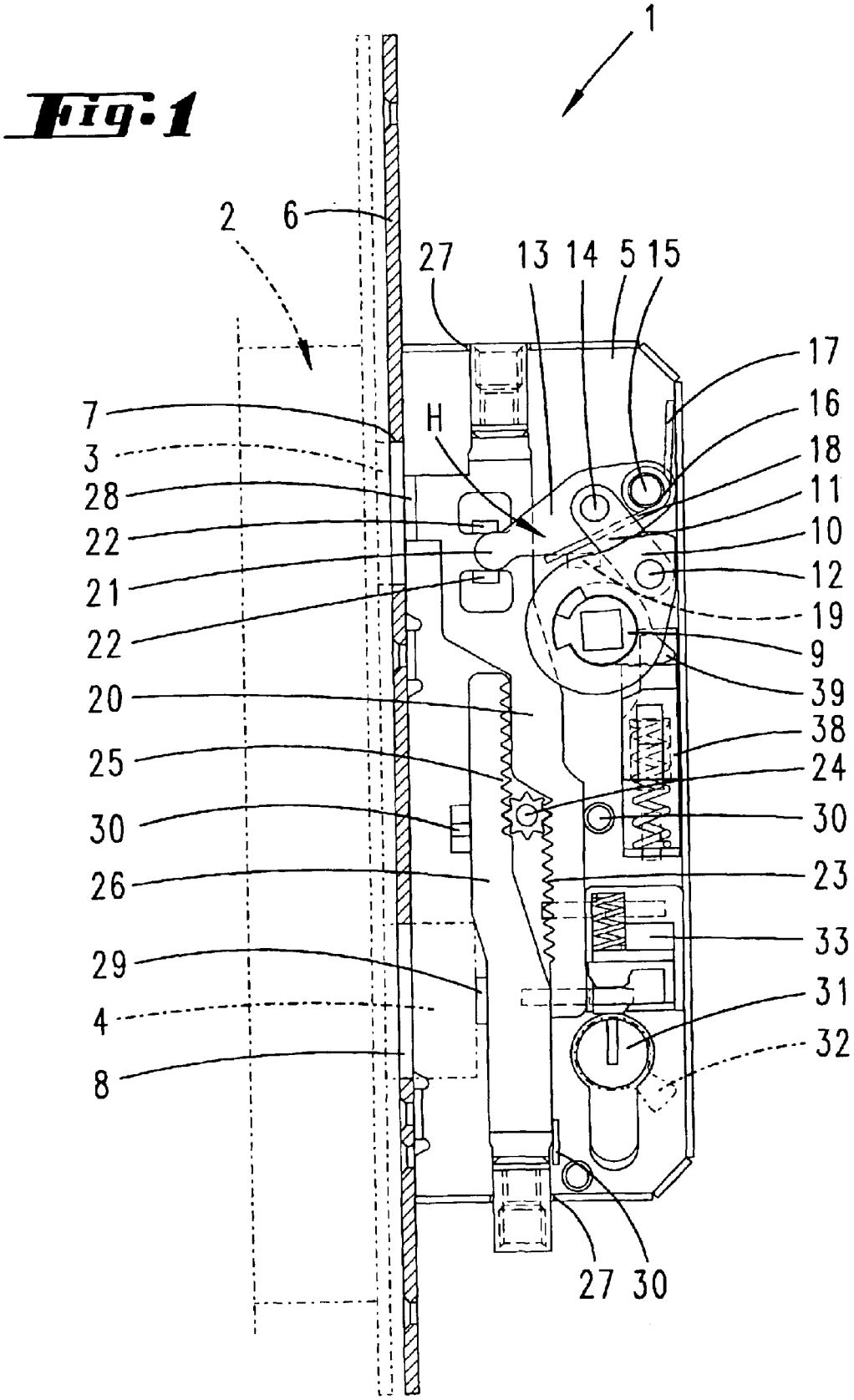
FIG. 1 shows an illustration of an espagnolette, illustrated without a lock cover, for a fixed leaf with driving-rod connection slides displaced in the open position and a mating lock, associated with a moving leaf, illustrated by chain-dotted lines.
Figure 2:
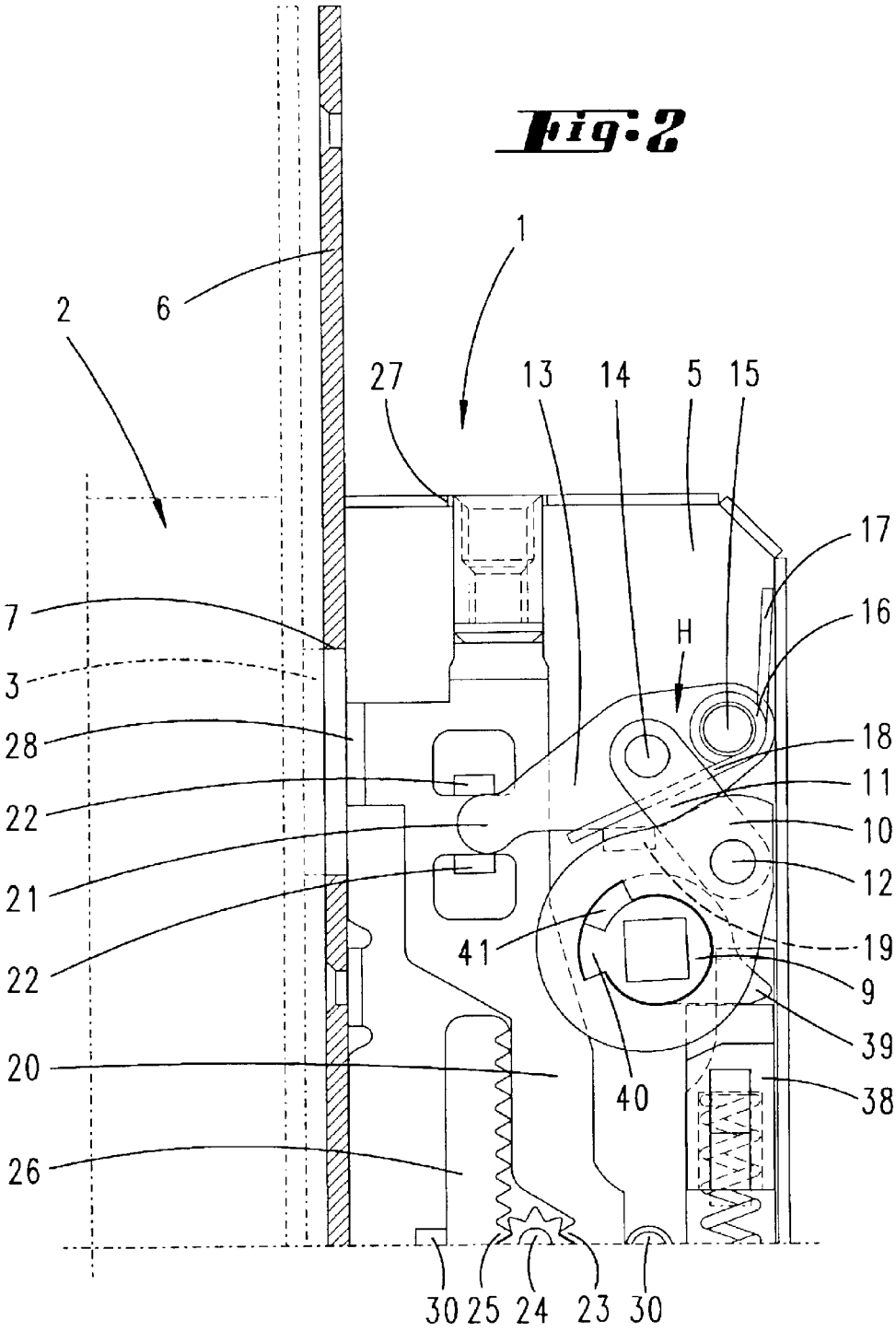
FIG. 2 shows an enlarged detail from FIG. 1 relating to the region of a handle follower.
Figure 3:
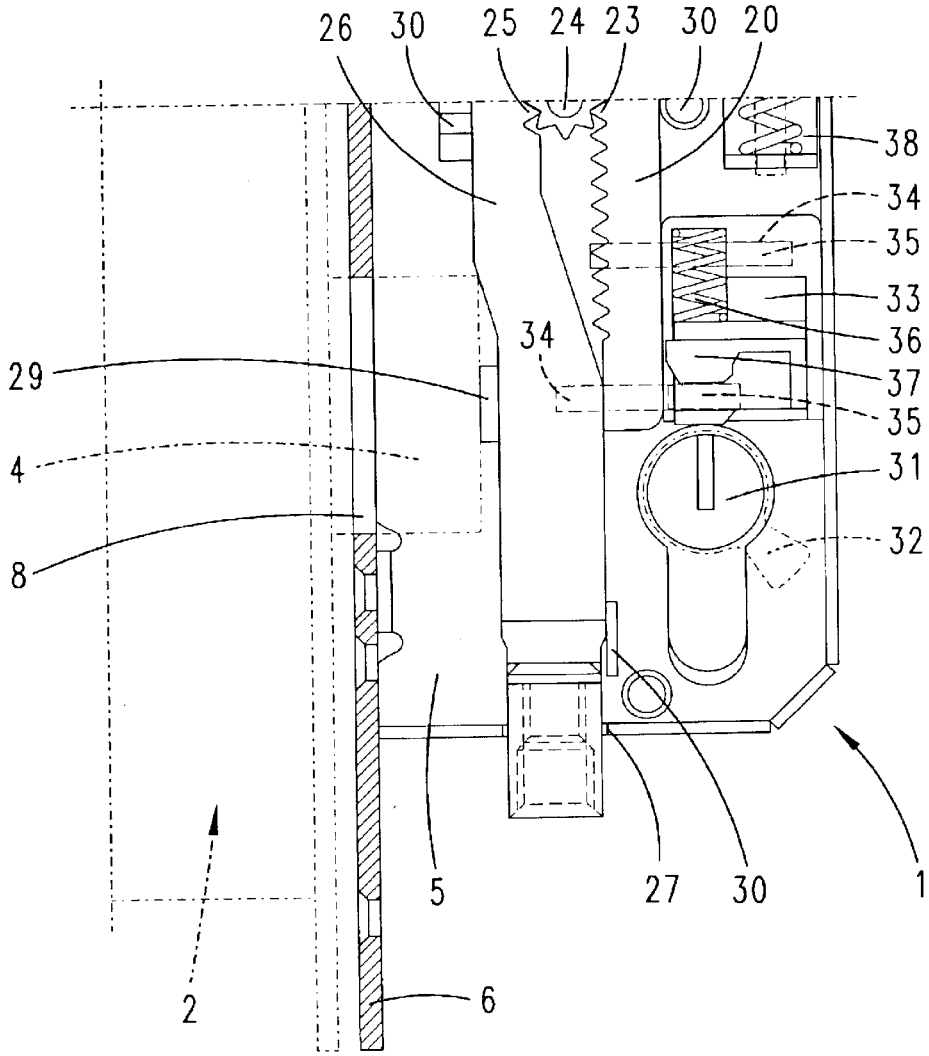
FIG. 3 shows a further enlarged detail from FIG. 1 relating to the region of a blocking bolt.

1 designates an espagnolette which is associated with a fixed leaf (not illustrated) of a double-leaf door. The moving leaf (not illustrated) of the double-leaf door is assigned a mating lock 2, which is illustrated by chain-dotted lines. The mating lock 2 has both a transversely displaceable latch 3 and a transversely displaceable blocking bolt 4.

The lock internals of the espagnolette 1 are enclosed by a lock case 5 with a lock cover (not illustrated). On a longitudinal side which is associated with the rebate of the fixed leaf, the lock case 5 has a lock case front 6. The lock case front 6 has entry openings 7 and 8 passing through it, the entry opening 7 being associated with the latch 3, the entry opening 8 being associated with the blocking bolt 4, of the mating lock 2.

Mounted approximately level with the entry opening 7 in the lock case 5 is a handle follower 9, which has a follower arm 10. A link 11 is connected in a rotatable manner to the follower arm 10 via a pin 12. The other end of the link 11 engages over a driving-rod drive lever 13, which is attached in a pivotable manner to the link 11 via a pin 14. The driving-rod drive lever 13 is mounted in a rotatable manner on a pin 15 associated with the lock case 5. The pin 15 also carries a leg spring 16, a leg 17 being supported on the wall of the lock case 5 and a leg 18 being supported on a block 19 of the driving-rod drive lever 13.

The driving-rod drive lever 13 acts on a driving-rod connection slide 20 by way of the free end 21, which is located opposite the pin 15. In this case, the free end 21 is secured in terms of movement in the displacement direction of the connection slide 20 between angled-out extensions 22 of the driving-rod connection slide 20. The follower arm 10 as well as the link 11 and the drive lever 13 with the leg spring 16 thus form a toggle-lever-transmission mechanism H for the displacement of the driving-rod connection slide 20.

The driving-rod connection slide 20, which is disposed parallel to the lock case front 6, has a toothing formation 23 which engages in a mating toothing formation of a gearwheel 24. Accordingly, a toothing formation 25 of a driving-rod connection slide 26, which is likewise disposed parallel to the lock case front 6 and in a mirror-symmetrical manner in relation to the connection slide 20, engages in the mating toothing formation of the gearwheel 24. The driving-rod connection slides 20 and 26, which can be displaced in opposite directions via the toothed-wheel drive and are coupled to one another for movement via the latter, may be provided with driving rods (not illustrated) at their free ends.

For the through-passage of the connection-slide ends or of the driving rods (not illustrated), the lock case has exit openings 27 on its end peripheral edges.

The driving-rod connection slides 20 and 26 are preferably produced as punched and bent parts. The driving-rod connection slides 20 and 26 also each have a blocking element in the form of angled portions 28 and 29. In this case, the angled portion 28 is associated with the driving-rod connection slide 20 and the angled portion 29 is associated with the driving-rod connection slide 26. The driving-rod connection slides 20 and 26 are guided by guide blocks 30 which extend from the base of the lock case 5.

The lock case 5 of the espagnolette 1 is preferably provided with a lock cylinder 31, which has a locking member 32. Above the lock cylinder 31, a blocking bolt 33 is guided in a transversely displaceable manner in relation to the driving-rod connection slide 20 on the lock base of the lock case 5, for which purpose the lock base has slots 34 which are arranged transversely to the driving-rod connection slide 20 and into which sliding blocks 35 of the blocking bolt 33 enter. Furthermore, the blocking bolt 33 is provided with a tumbler 37 which can be displaced in a linear manner in relation to the sliding blocks 35 and is loaded by a spring 36.

If the espagnolette 1 is located in an open position according to FIG. 1, the angled portions 28 and 29 of the driving-rod connection slides 20 and 26, said angled portions forming the blocking elements, prevent the latch 3 and the blocking bolt 4, respectively, of the mating lock 2 from entering correctly. The angled portion 28, which is positioned in the vicinity of the entry opening 7 and is located in the movement path of the latch 3, thus only allows the latch 3 to spring part of the way in. The angled portion 29 is positioned further toward the far side of the lock case front 6 and is located in the movement region of the blocking bolt 4, as a result of which it is likewise the case that the latter cannot extend fully.

The partial displacement path of the blocking bolt 4 here is less than the first-turn extension path of the blocking bolt 33. This results in it not being possible for the key which is associated with the moving-leaf lock mechanism 2, and belongs to a cylinder lock (not illustrated), to be withdrawn when the espagnolette 1 is located in the open position (see, in particular, the illustration in FIG. 1).

If the locked position is produced, by means of a handle (not illustrated) via the handle follower 9, the driving-rod connection slides 20 and 26 are displaced outward in opposite directions out of the lock case 5. As a result of this rotary actuation of the handle, which takes place in the counterclockwise direction in the illustrations, the lever-transmission mechanism H assumes a position on the far side of the dead-center position T. Following the rotary actuation, however, the handle follower 9 is displaced back into a neutral center position by means of a spring assembly 38. For this purpose, the handle follower 9 has a hook-like, radially projecting extension 39 which is activated by the spring element 38. The handle follower 9 also has a radially projecting circle-arc-shaped extension 40, which is guided in a stop-limited manner in a circle-arc-shaped cutout 41 of the follower arm 10.

By virtue of the displacement of the driving-rod connection slides 20 and 26 into the locked position, the angled portions 28 and 29 of the driving-rod connection slides 20 and 26, said angled portions forming the blocking elements, are also displaced out of the movement region of the latch 3 and of the blocking bolt 4, respectively. In this case, on the one hand, the angled portion 29 has assumed a position which is located beneath the entry opening 8 of the lock case front 6 and, on the other hand, the angled portion 28 has assumed a position above the entry opening 7 of the lock case front 6. Accordingly, it is then possible for the latch 3 and the blocking bolt 4 of the mating lock 2 to extend correctly into the espagnolette 1.

By means of the key-actuable lock cylinder 31, it is possible, via the locking member 32 of the latter, for the blocking bolt 33 to be displaced transversely to the displacement direction of the driving-rod connection slide 20. This counteracts an opening movement of the driving-rod connection slides 20 and 26 by means of a handle-follower actuation.

In order to move the espagnolette 1 into an open position, the blocking bolt 33 has to be displaced back by means of key actuation, so that the displacement path for the driving-rod connection slide 20 and, via the gearwheel 24, the driving-rod connection slide 26 at the same time are released. With easy rotary actuation of the handle follower 9 in the clockwise direction—in relation to the illustrations—beyond the dead-center position T of the lever-transmission mechanism H, the prestressed leg spring 16 dissipates its stressing force to the lever-transmission mechanism H and causes the same to displace the driving-rod connection slide 20 inward in a linear manner by means of the driving-rod drive lever 13. Accordingly, the driving-rod connection slide 20 is displaced inward in a linear manner via the gearwheel 24. The espagnolette 1 is thus located in an open position (see, in particular the illustration in FIG. 1).

Figure 4:
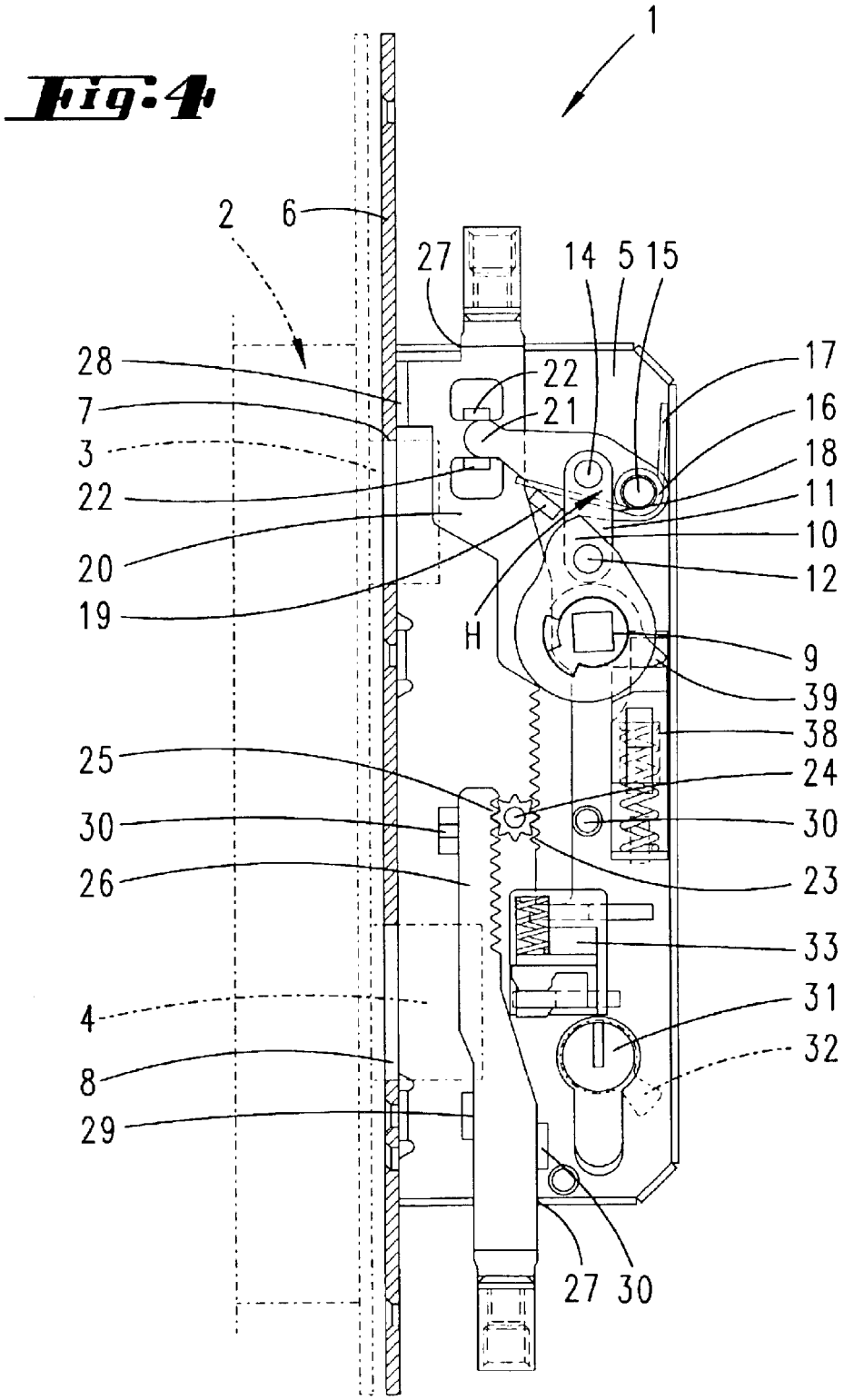
FIG. 4 shows an illustration according to FIG. 1, but with the driving-rod connection slides displaced into the blocking position.
Figure 5:
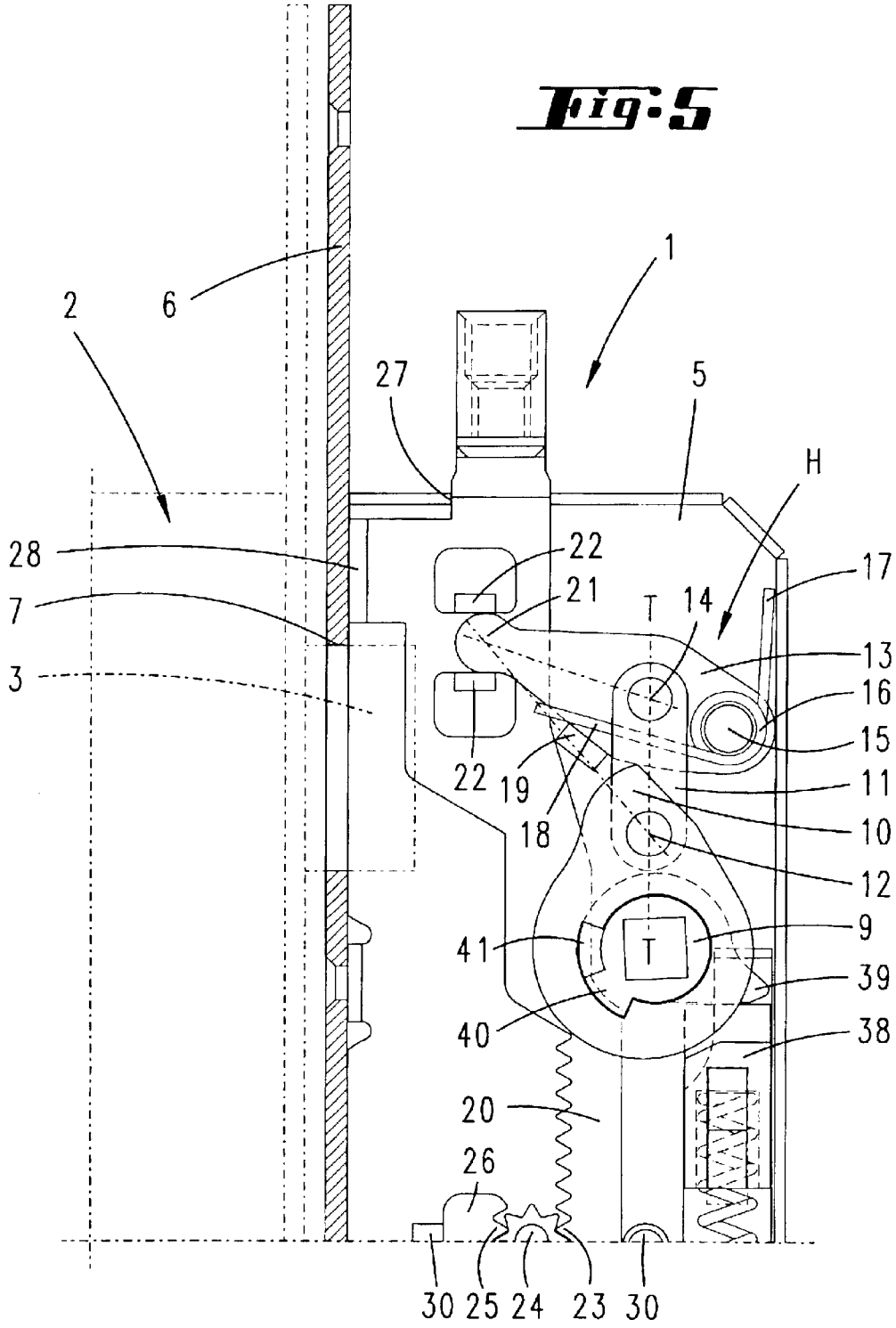
FIG. 5 shows an illustration according to FIG. 2, but relating to the position according to FIG. 4.
Figure 6:
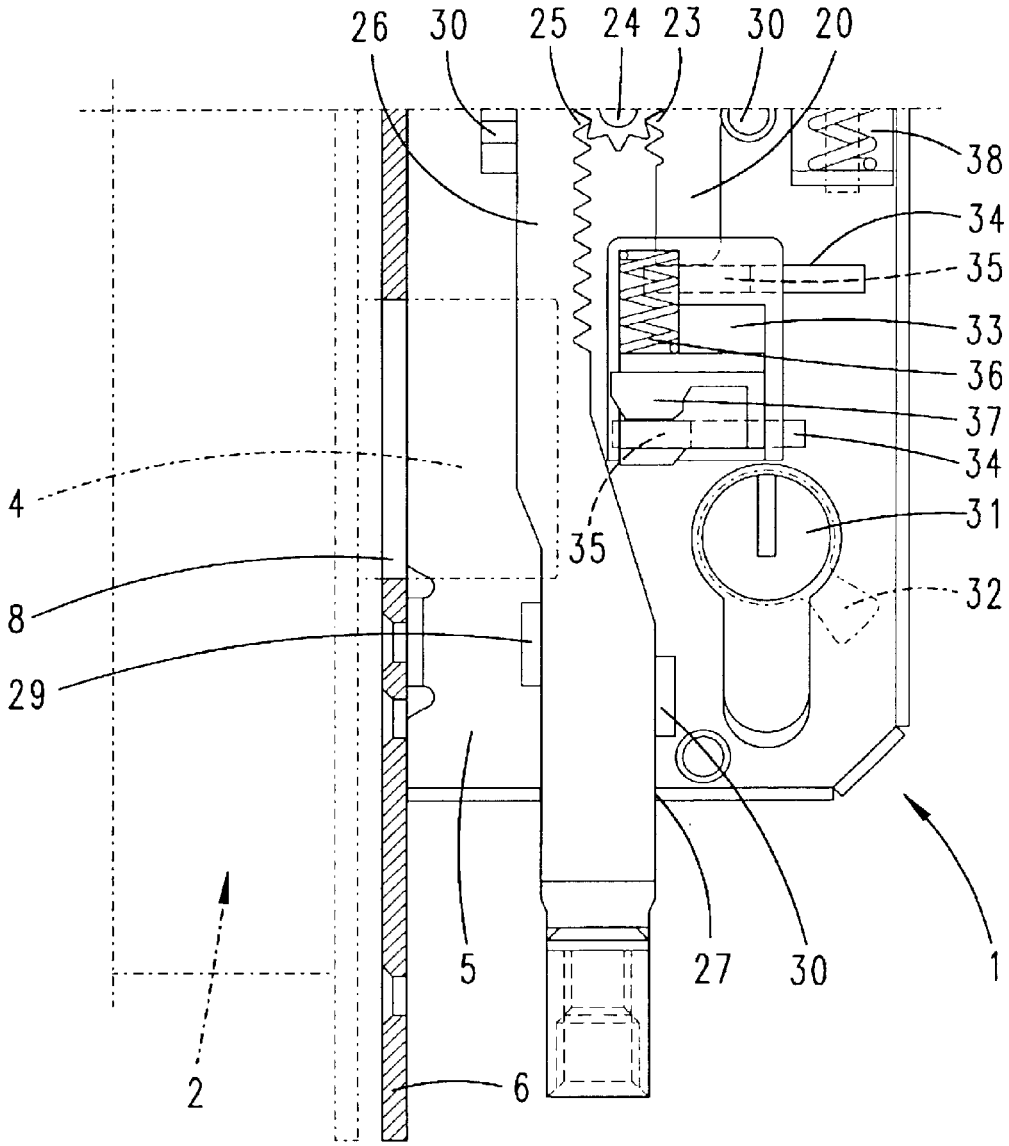
FIG. 6 shows an illustration according to FIG. 3, but relating to the position according to FIG. 4.

If the latch 3 and the bolt 4 of the mating lock 2 are located in the locked position, then, starting from the locked position illustrated in FIG. 4, it is not possible for the driving-rod connection slides 20 and 26 to be displaced back since the latch 3 and the bolt 4, respectively, of the mating lock 2 are located in the movement path of the blocking element 28 and of the blocking element 29, respectively. It is only when the bolt 4 and the latch 3 of the mating lock 2 have been drawn back that the fixed-leaf lock mechanism 1 can be displaced into the open position. This takes place via the abovedescribed pivoting of the link mechanism H.

The driving rods are secured in the locked position via the over-dead-center position of the lever-transmission mechanism H.

I claim:

1. An espangolette with a lock mechanism (1) for a fixed leaf of a double-leaf door, and having a lock case (5) in which there is mounted a handle follower (9) by rotational actuation of which at least one driving-rod connection slide (20, 26) is displaceable parallel to a lock case front (6), an end of the rod connection slide forming or controlling a bolt, the espagnolette having an entry opening (7, 8) for a bolt (4) or a latch (3) of a lock mechanism (2) associated with a moving leaf, the driving-rod connection slide (20, 26) being guided in the lock case (5) and being assigned a blocking element (28, 29) which, in an open position of the lock mechanism (1), is located in a region of the entry opening (7, 8), in order to obstruct entry of the bolt (4) of the moving-leaf lock mechanism (2), and, in a locked position of the lock mechanism (1), is located outside the region of the entry opening (8) such that displaceability of the driving-rod connection slide (26) into the open position is blockable by entry of the bolt (4) of the moving-leaf lock mechanism, wherein the follower (9) acts on the driving-rod connection slide (26) by a lever-transmission mechanism (H), a link (11) which acts, at one end, on a driving-rod drive lever (13) and, at an other end, on an arm (10) of the handle follower (9) being brought over a dead-center position (T) when the follower (9) is rotated.

2. Espangolette according to claim 1, further comprising a spring (16) which loads the driving-rod connection slide (26) in direction of the open position.

3. Espagnolette according to claim 2, wherein the spring (16) acts on the driving-rod drive lever (13).

4. Espagnolette according to claim 1, wherein there are two of said driving-rod connection slides (20, 26) that are displaceable in opposite directions and are coupled to one another for movement via a toothed-wheel drive.

5. Espagnolette according to claim 1, wherein there is a second entry opening (7) for the latch (3) or a bolt of the moving-leaf lock mechanism, said second entry opening likewise being assigned to a blocking element (28).

6. Espagnolette according to claim 4, wherein each of said two driving-rod connection slides (20, 26) is assigned a blocking element (28, 29).

7. Espagnolette according to claim 1, wherein the blocking element (28, 29) is formed by an angled portion of the driving-rod connection slide (20, 26), which is a punched and bent part.

8. Espagnolette according to claim 1, wherein the driving-rod connection slide (20, 26) is blockable in its locked position by a blocking bolt (33).

9. Espagnolette according to claim 8, wherein the blocking bolt (33) is displaceable by a locking member (32) of a lock cylinder (31) and, in blocking position, is located in a displacement path of the driving-rod connection slide (26).

10. Espagnolette according to claim 1, wherein in its position in which it blocks the entry opening (7) of the latch (3) of the moving-leaf lock mechanism (2), the blocking element (28), which is associated with the latch (3), allows the latch (3) to spring part of the way in.

11. Espagnolette according to claim 1, wherein in its blocking position, the blocking element (29), which is associated with the bolt (4) of the moving-leaf lock mechanism (2), allows the bolt (4) of the moving-leaf lock mechanism (2) to enter part of the way in.

12. Espagnolette according to claim 1, wherein the at least one driving-rod connection slide is secured in a locked position as a result of an over-dead-center position of the lever-transmission mechanism (H) driving them.

13. An espagnolette with a lock mechanism (1) for a fixed leaf of a double-leaf door, and having a lock case (5) in which there is mounted a handle follower (9) by rotational actuation of which at least one driving-rod connection slide (20, 26) is displaceable parallel to a lock case front (6), an end of the rod connection slide forming or controlling a bolt, the espagnolette having an entry opening (7, 8) for a bolt (4) or a latch (3) of a lock mechanism (2) associated with a moving leaf, the driving-rod connection slide (20, 26) being guided in the lock case (5) and being assigned a blocking element (28, 29) which, in an open position of the lock mechanism (1), is located in a region of the entry opening (7, 8), in order to obstruct entry of the bolt (4) of the moving-leaf lock mechanism (2), and, in a locked position of the lock mechanism (1), is located outside the region of the entry opening (8) such that displaceability of the driving-rod connection slide (26) into the open position is blockable by entry of the bolt (4) of the moving-leaf lock mechanism, wherein the follower (9) acts on the driving-rod connection slide (26) by a lever-transmission mechanism (H), a link (11) which acts, at one end, on a driving-rod drive lever (13) and, at an other end, on an arm (10) of the handle follower (9) being brought over a dead-center position (T) when the follower (9) is rotated; and wherein there is play for movement between the handle follower (9) and follower arm (10) such that the handle follower (9) is kept in a neutral center position by a spring element (38) irrespectively of displacement position of driving-rod connection slide (lever) (26).

* * * * *